US012250964B2

(12) United States Patent
Gibson

(10) Patent No.: US 12,250,964 B2
(45) Date of Patent: Mar. 18, 2025

(54) ADDITIVE ASSEMBLY FOR A TOBACCO FILTER TOW

(71) Applicant: British American Tobacco (Investments) Limited, London (GB)

(72) Inventor: Paul Gibson, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 683 days.

(21) Appl. No.: 17/294,262

(22) PCT Filed: Nov. 11, 2019

(86) PCT No.: PCT/GB2019/053186
§ 371 (c)(1),
(2) Date: May 14, 2021

(87) PCT Pub. No.: WO2020/099845
PCT Pub. Date: May 22, 2020

(65) Prior Publication Data

US 2022/0007711 A1 Jan. 13, 2022

(30) Foreign Application Priority Data

Nov. 14, 2018 (GB) ..... 1818587

(51) Int. Cl.
*A24D 3/04* (2006.01)
*A24C 5/52* (2006.01)
(Continued)

(52) U.S. Cl.
CPC ..... *A24D 3/0216* (2013.01); *A24C 5/52* (2013.01); *A24D 3/0233* (2013.01); *A24D 3/061* (2013.01)

(58) Field of Classification Search
None
See application file for complete search history.

(56) References Cited

U.S. PATENT DOCUMENTS 5,441,060 A * 8/1995 Rose ..... A61M 15/0028 131/273
5,479,948 A * 1/1996 Counts ..... A24F 40/42 131/194

(Continued)

FOREIGN PATENT DOCUMENTS

JP 2013523108 A 6/2013
JP 2014528242 A 10/2014

(Continued)

OTHER PUBLICATIONS

NO 144690 B English Translation Obtained from Dav, pp. 1-7 (Year: 1981).*

(Continued)

*Primary Examiner* — Philip Y Louie
*Assistant Examiner* — Madeleine P Delacruz
(74) *Attorney, Agent, or Firm* — Husch Blackwell

(57) ABSTRACT

A method of preparing an additive assembly for insertion into tobacco industry product filter tow, comprising: providing a web comprising an array of discrete portions of additive disposed in or on the web, the array comprising columns of at least two discrete portions of additive across a width of the web; and forming a chain of discrete portions of additive in the web. The chain comprises: connecting portions that connect adjacent discrete portions of additive in a column of the array; and connecting portions that are configured to be nonlinear to connect discrete portions of additive in respective adjacent columns of the array.

19 Claims, 10 Drawing Sheets

(51) Int. Cl.

| | |
|---|---|
| ***A24D 3/02*** | (2006.01) |
| ***A24D 3/06*** | (2006.01) |
| ***B23K 26/36*** | (2014.01) |
| ***B31F 1/07*** | (2006.01) |

(56) References Cited

U.S. PATENT DOCUMENTS

| | | | | |
|---|---|---|---|---|
| 2012/0080043 | A1 | 4/2012 | Naenen et al. | |
| 2014/0026900 | A1 | 1/2014 | Karles et al. | |
| 2014/0209111 | A1* | 7/2014 | Russell | A24D 3/0275 131/335 |
| 2017/0303583 | A1 | 10/2017 | Awty et al. | |

FOREIGN PATENT DOCUMENTS

| | | | | | |
|---|---|---|---|---|---|
| NO | 144690 | B | * | 7/1981 | |
| RU | 2550333 | C2 | | 5/2015 | |
| WO | WO2009127487 | A1 | | 10/2009 | |
| WO | 2010003899 | A1 | | 1/2010 | |
| WO | WO2010063569 | A1 | | 6/2010 | |
| WO | WO20130117283 | A1 | | 8/2013 | |
| WO | WO-2017029149 | A1 | * | 2/2017 | A24B 15/167 |

OTHER PUBLICATIONS

International Search Report and Written Opinion for PCT/GB2019/053186, dated Mar. 31, 2020, 29 pages.

"International Preliminary Report on Patentability for Application No. PCT/GB2019/053186, completed on May 27, 2021", 11 pages.

"Invitation to Pay Additional Fees for the PCT patent application No. PCT/GB2019/053186 mailed on Feb. 10, 2020", 10 pages.

"Office Action and Search Report received for Russian Application No. 2021117070, mailed Dec. 27, 2021", 20 pages.

"Office Action received for Brazilian Patent Application No. 112021009488-1, mailed on Aug. 7, 2023", 4 pages (Official Copy Only).

"Reasons for Rejection received for Korean Patent Application No. 10-2021-7017587, mailed on Aug. 8, 2023", 8 pages (4 pages of English Translation and 4 pages of Official Copy).

* cited by examiner

ADDITIVE ASSEMBLY FOR A TOBACCO FILTER TOW

PRIORITY CLAIM

The present application is a National Phase entry of PCT Application No. PCT/GB2019/053186, filed Nov. 11, 2019, which claims priority from Great Britain Application No. 1818587.6, filed Nov. 14, 2018, each of which is hereby fully incorporated herein by reference.

TECHNICAL FIELD

The present invention relates to an additive assembly and a method of preparing an additive assembly for insertion into tobacco industry product filter tow.

BACKGROUND

Known tobacco industry products, such as cigarettes, comprise frangible capsules embedded in filter material that are configured to release an additive when broken or crushed. A problem to be overcome is the process of embedding frangible capsules and other additive release mechanisms into the filter material during assembly of a cigarette. A particular challenge is posed by the high rate of filter material throughput required to deliver a satisfactory rate of manufacture of the cigarettes.

SUMMARY

In accordance with embodiments of the invention, there is provided a method of preparing an additive assembly for insertion into tobacco industry product filter tow, the method comprising:

- providing a web comprising an array of discrete portions of additive disposed in/on the web, the array comprising columns of at least two discrete portions of additive across a width of the web;
- forming a chain of discrete portions of additive in the web, the chain comprising:
- first connecting portions that connect adjacent discrete portions of additive in a column of the array;
- and second connecting portions that are configured to be nonlinear to connect discrete portions of additive in respective adjacent columns of the array.

The method may further comprise forming the array of discrete portions of additive in the web.

Forming the array of discrete portions of additive in the web may comprise:

- providing a first sheet comprising an array of pockets;
- introducing an additive into the pockets; and
- introducing a second sheet overlying the first sheet to seal the pockets and form the web.

The method may further comprise forming the array of pockets in the first sheet.

Forming the array of pockets may comprise passing the first sheet between a pair of embossing rollers to emboss the pockets into the first sheet.

The first and second sheets may be passed in overlying relation between a pair of rollers wherein at least one of the pair of rollers is heated to fuse the first and second sheets together.

Forming the chain may comprise passing the web of material between a pair of cutting rollers to cut the chain into the web of material.

Forming the chain may comprise using a laser to ablate the web around the discrete portions of additive.

The web of material may comprise a polymer.

The connecting portions that are configured to be nonlinear may be curved.

Also in accordance with embodiments of the invention there is provided a chain for insertion into tobacco industry product filter tow, the chain comprising discrete portions of additive linked by connecting portions, wherein at least one of the connecting portions is configured to be nonlinear.

The discrete portions of additive may comprise additive filled blisters, wherein the blisters comprise a flat surface, the flat surfaces of at least two adjacent blisters in the chain being in planar alignment, the at least two adjacent blisters being connected by the at least one connecting portion configured to be nonlinear, and wherein the at least one connecting portion configured to be nonlinear comprises compensating geometry configured so that, following the application of a straightening force to the at least one connecting portion configured to be nonlinear, said flat surfaces remain in planar alignment.

The compensating geometry may comprise a pleated section in the connecting portion configured to be nonlinear.

The pleated section may be embossed or scored into the connecting portion configured to be nonlinear.

The pleated section may comprise: first fold lines configured to ease compression radially outward of a neutral axis of the connecting portion configured to be nonlinear; and second fold lines configured to ease tension radially inward of the neutral axis.

The first fold lines may extend radially from a point located on the neutral axis to an outer edge of the connecting portion configured to be nonlinear.

The second fold lines may extend radially from said point on the neutral axis to an inner edge of the connecting portion configured to be nonlinear.

Material delimited by the second fold lines may be pre-stretched to provide slack in the connecting portion configured to be nonlinear between the neutral axis and the inner edge.

Also in accordance with embodiments of the invention, there is provided a method of preparing a tobacco industry product using the additive chain of any of claims 10 to 16, comprising:

- drawing the chain of discrete portions of additive into tobacco industry material;
- forming the tobacco industry material into a continuous rod;
- wrapping the tobacco industry material with a wrapping material.

Also in accordance with embodiments of the invention, there is provided a tobacco industry product comprising a filter having a discrete portion of additive, wherein the discrete portion of additive is attached to a connecting portion configured to be nonlinear.

Also in accordance with embodiments of the invention, there is provided a tobacco industry product comprising a filter having two discrete portions of additive embedded therein, wherein the discrete portions of additive are attached to each other by a connecting portion configured to be nonlinear.

BRIEF DESCRIPTION OF THE DRAWINGS

Embodiments of the invention will now be described, by way of example only, with reference to the accompanying drawings, in which.

DETAILED DESCRIPTION

Figure 1:
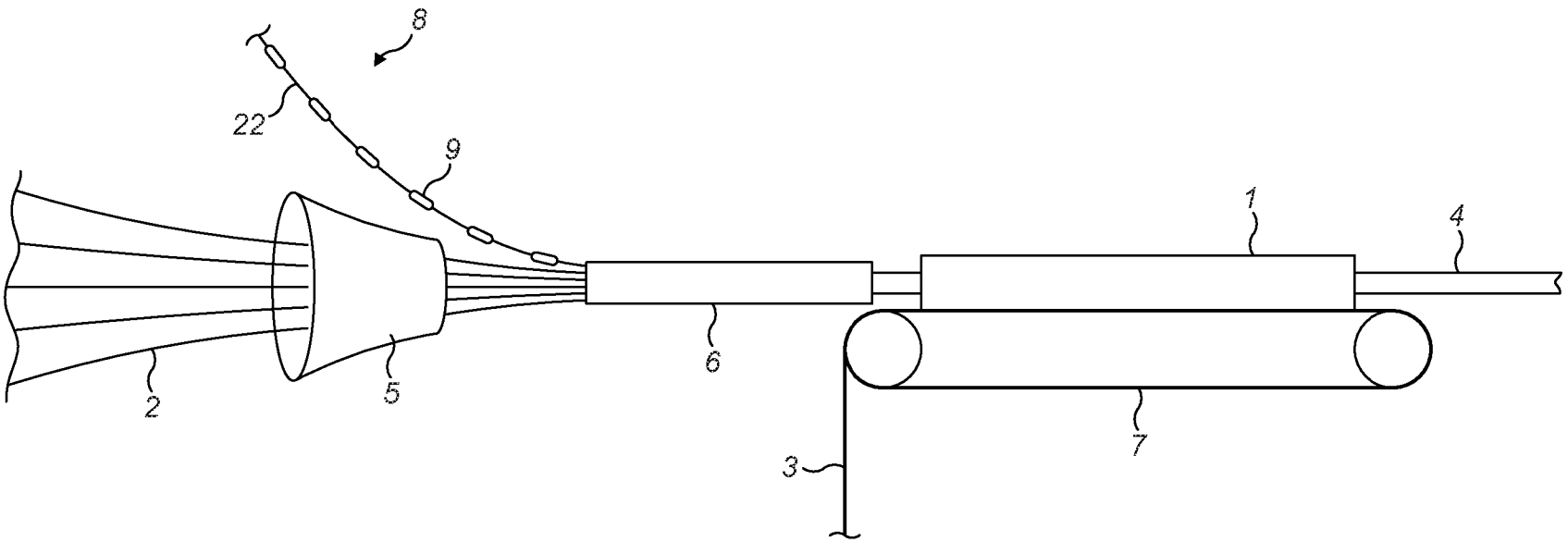
FIG. 1 shows a schematic of a filter rod making machine.

FIG. 1 shows a schematic view of a machine for making filter rods for use in tobacco industry products, such as cigarettes. The machine comprises a garniture 1 which is configured to receive filter plug material 2 and filter wrapping material 3 to form a continuous wrapped filter rod 4. In operation, filter material 2, usually in the form of cellulose acetate filter tow, is drawn from a source (not shown), stretched in a set of stretching rollers (not shown) and compressed through a stuffer jet 5. The stuffer jet 5 sends air and filter tow 2 into a forming guide 6 which forces the tow into a rod shape before it passes into the garniture 1 for wrapping.

A continuous garniture belt 7 carries filter wrapping paper 3 through the garniture 1. The garniture 1 is shaped to cause the belt 7 and filter wrapping paper 3 to envelop the tow 2, the filter wrapping paper 3 being adhered about the rod of filter material, to make the continuous wrapped filter rod 4. During a later unillustrated operation, the continuous filter rod 4 is cut into individual filter rod lengths for combination with a tobacco industry product, such as a cigarette.

An additive assembly 8 comprising discrete portions of additive 9, such as additive blisters 9, is configured for insertion into the filter tow 2. The spacing between blisters 9 in the additive assembly 8 is predetermined so that the individual filter rod lengths comprise a single blister 9 at a predetermined axial location. The additive blisters 9 may contain water or another additive substance such as flavours, organoleptic substances or smoke modifying substances. When using a tobacco industry product comprising a blister 9 containing filter rod, an adult user can burst the blister 9 to release the additive substance by applying pressure to outside of the filter rod until the internal pressure causes the blister 9 to rupture.

The additive assembly 8 comprises a chain 22 of additive containing blisters 9. As shown in FIG. 1, the chain 22 of blisters 9 is fed into the machine for making filter rods, preferably between the stuffer jet 5 and the forming guide 6. As the tow 2 is compressed into a rod shape in the forming guide 6, it closes around the blisters 9 to pull the chain 22 on through the garniture 1. The result is that the blisters 9 are completely embedded in the continuous filter rod 4 in an evenly spaced fashion.

Figure 2:
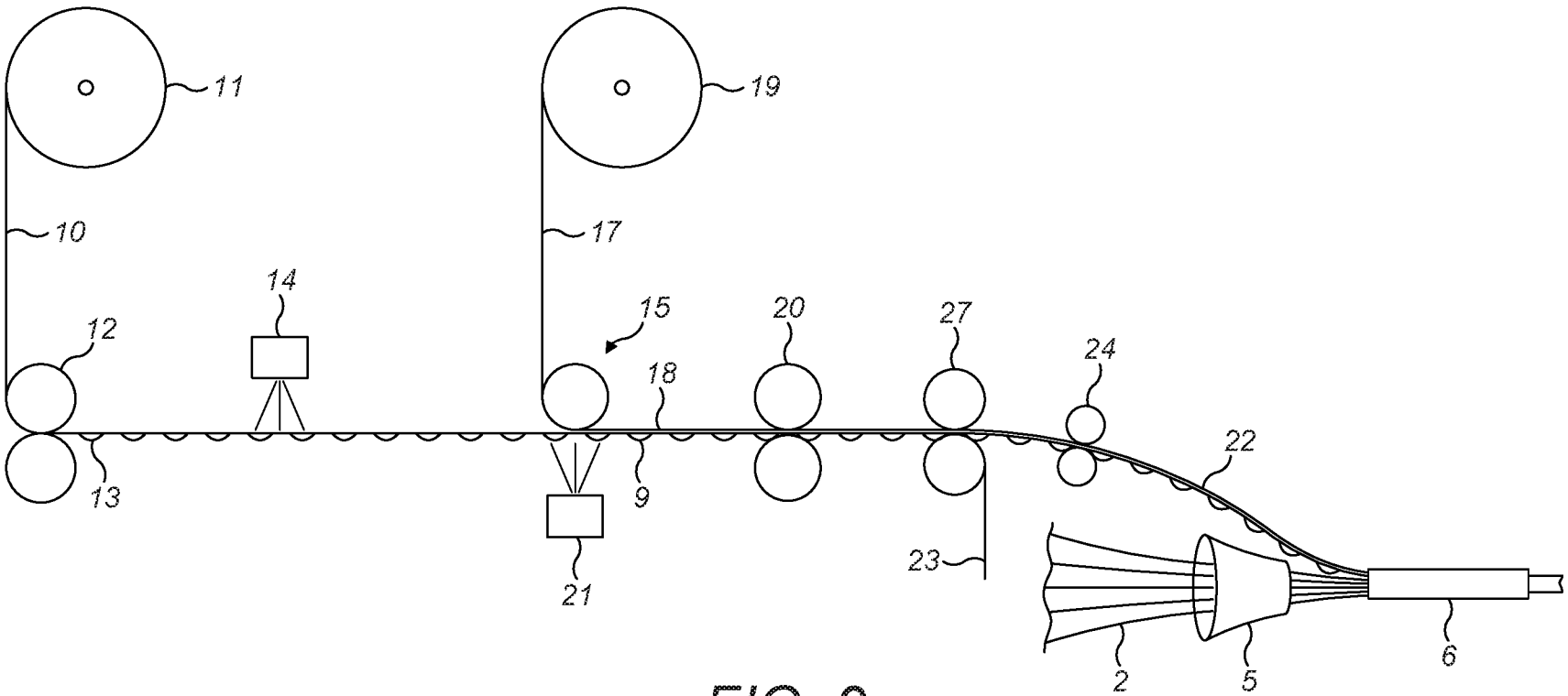
FIG. 2 shows a schematic of an additive assembly maker.

FIG. 2 illustrates the preparation of the additive assembly 8 according to one embodiment. A first sheet of material 10 is drawn from a reel 11 through a set of embossing rollers 12. The embossing rollers 12 draw the sheet of material 10 off the reel 11 and embossed it 10 with an array of pockets 13. The particular pattern of pockets 13 is mapped across the face of one of the rollers 12 as a series of protrusions and across the other of the rollers 12 as a series of corresponding impressions. As the first sheet of material 10 passes through the rollers 12, the protrusions and impressions mate at the interface between the rollers 12, trapping the sheet 10 in between and plastically embossing into it 10 the array of pockets 13.

The first sheet of material 10 complete with the embossed pockets 13 passes to an additive filling station 14, wherein the pockets 13 are filled with the additive. The additive filling station 14 may comprise an array of nozzles which can precisely deliver the additive into each of the pockets 13 by, for example, activating each of the nozzles in register with the passing of pockets 13 through the filling station 14. Alternatively, the nozzles may produce a mist of additive which settles on the sheet 10 and fills the pockets 13. Excess additive can be removed from the surface of the sheet 10 by a squeegee (not shown) downstream of the nozzles.

Once the pockets 13 have been filled, the sheet 10 passes to a sealing station 15 where the pockets 13 are sealed to form the blisters 9. The sealing process comprises the introduction of a second sheet 17 to overly the first 10 in contiguous relation, thereby enclosing the additive filled pockets to form additive filled blisters 9. The first and second sheets 10, 17 are combined together by, for example, heat, to form a web of web 18.

The second sheet 17 is drawn from a second reel 19 by a pair of driving rollers 20. The first and second sheets 10, 17 are arranged in parallel alignment prior to being drawn contiguously together through the driving rollers 20. The driving rollers 20 may be provided with a series of pockets in their surface which corresponds with the pattern of blisters 9 formed in the web 18 to allow the additive filled blisters 9 to pass between the rollers 20.

In one example, the driving rollers 20 may be provided with a heated surface to fuse the first and second sheets 10, 17 together, forming the web 18. In another example, the first and second sheets 10, 17 may pass a heat source 21; the heat source 21 being positioned to transfer heat to the first and second sheets 10, 17. The heat source 21 maybe an infrared heater which irradiates the first and second sheets 10, 17 to cause them to fuse together. Or, in another example, the heat source 21 may be a convection heater which locally heats air, the heated air transferring heat to the first and second sheets 10, 17 by convection.

Heat from the heat source 21 may fuse first and second sheets 10, 17 together by partially melting at least a portion of the first and second sheets 10, 17. The first and second sheets 10, 17 may be made from a common polymer material so that the partially melted portions form a homogenous part when cooled back into a solid state. Alternatively, the first 10 and or second sheet 17 may be provided with an adhesive layer or coating. The adhesive layer may be a heat activated adhesive so that it bonds the first and second sheets 10, 17 together following application of heat in any of the ways described above.

Following the forming of a web 18 from the first and second sheets 10, 17, the array of blisters 9 formed in the web 18 are cut out to form the chain 22 of additive containing blisters 9. The chain 22 maybe drawn away from the remaining waste web 23 by blister chain driving rollers 24 and then baled into a crate for further use, or fed directly into the filter tow 2 as described above.

Figure 3:
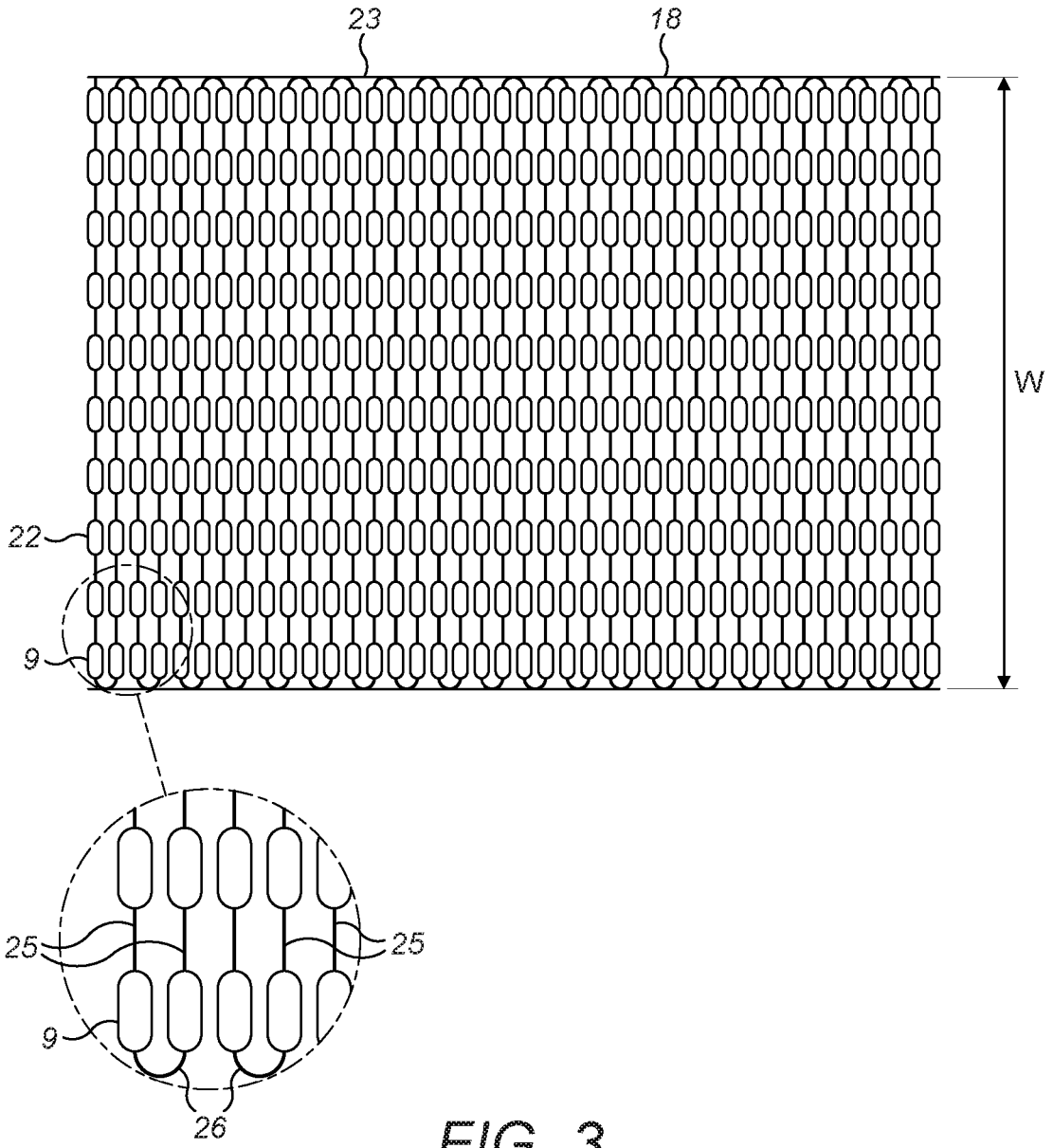
FIG. 3 shows an additive assembly.

In order to increase the throughput of blisters 9, the array of pockets 13 comprises at least two pockets 13 spaced across the width of the first sheet 10. This corresponds to at least two blisters 9 formed across the width of the web 18, following sealing of the pockets 13 by the second sheet 17. Preferably, multiple blisters 9 are provided across the width W of the web 18, as shown in FIG. 3. This allows a large number of blisters 9 to be produced in a relatively short space of time, but presents the problem of converting the blister 9 array into individual blisters 9 that can be fed into filter tow 2. By cutting the web 18 into a chain 22 of blisters 9, the blisters 9 can be pulled into the filter tow 2 at an accelerated rate. For example, the blister chain 22 driving rollers 24 will travel at a greater tangential speed than the driving rollers 20 used to progress the web 18. This increased speed accounts for the unravelling of the chain 22 as it is cut from the web 18.

The precise arrangement of the array of blisters 9 can vary, but the preferred example is shown by FIG. 3. In this example, the blister chain 22 pattern cut into the web 18 snakes its way back and forth across the width of the web 18 and comprises connecting portions 25, 26 that connect adjacent blisters 9. The blister chain is arranged in columns connected by straight connecting portions 25. Each column extends across the width W of the web 18. End blisters 9 in adjacent columns are connected by curved connecting portions 26.

The term 'curved connection portion' means the curved connecting portions are curved when they are cut into the web 18 and not curved merely as a result of the web 18 being bent or deformed by gravity, or any other force. On the contrary, the curved connecting portions 26 are curved to allow the blister chain pattern to snake back and forth across the width of the web 18. It can be said then, that the curved connecting portions 26 are 'configured' to be curved.

The curved connecting portions 26 must be pulled straight when the blister chain 22 is unravelled for feeding into the filter tow material 2, as explained in greater detail below.

In one example, the blister chain 20 pattern is cut into the web 18 by a cooperating pair of cutting rollers 27 that crush cut the pattern into the web 18, see FIG. 2. The blister chain pattern is mapped across the face one of the two cutting rollers 27 as a bladed protrusion, the other of the two cutting rollers 27 may comprise the same pattern mapped as a corresponding impression or alternatively, the other of the two rollers may be provided with a smooth surface. As the web 18 passes between the cutting rollers 27, the bladed protrusion cuts the web 18 against the surface of the other of the two rollers 27, either by cooperation with the corresponding impression, where present, or by trapping the web 18 against the smooth surface.

In another example, the blister chain pattern is made by a laser cutter (not shown). The laser cutter comprises a laser emitting head disposed immediately above or below the web 18. The laser emitting head maps out the blister chain pattern by scanning back and forth across the surface of the web 18 as it passes.

Figure 4:
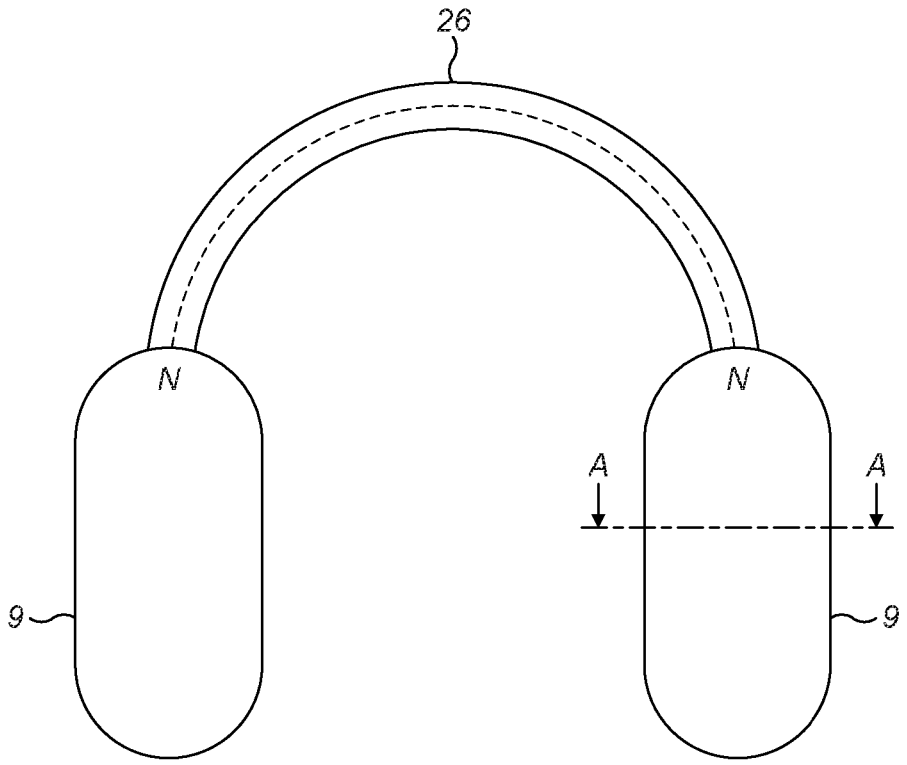
FIG. 4 shows a curved connecting portion of an additive assembly.

One particular problem associated with the unravelling of the blister chain 22 is that adjacent blisters 9 either side of the curved connecting portions 26 rotate relative to each other. This occurs due to the unequal distribution of stress across the curved connecting portion 26. A neutral axis N-N of an example curved connecting portion 26 is shown in FIG. 4. It follows that, during straightening, material radially outward of the neutral axis N-N of the curved connecting portion 26 is compressed during straightening, while material radially inward of the neutral axis N-N is tensioned. This imbalance of tension and compression manifests an out of plane force that rotates adjacent blisters 9 during straightening.

Figure 5:
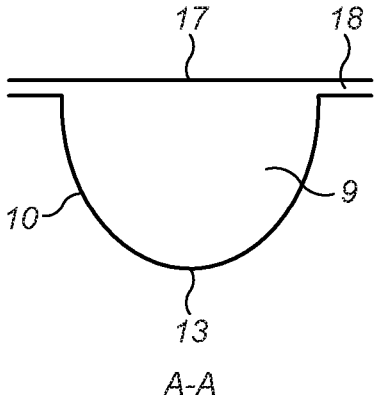
FIG. 5 shows a section of a blister of an additive assembly.

This rotating of adjacent blisters 9 is contrary to the objective of controlled orientation of the blisters 9 as they are fed into the tow 2. One reason for this objective is to ensure rotational alignment of the blisters 9—which are not entirely round in section—with a visual indicator on the filter wrapping paper 3. Referring to FIG. 5, it can be seen that the blisters 9 have the appearance of a semicircle in section; the circular part defined by the pocket 13 in the first sheet 10, whilst the second sheet 17 defines a flat surface 17 that seals the pocket, as shown in FIG. 5.

The lack of circularity of the blisters 9 mean the burst strength of any given blister 9 will depend on where around the blister 9 pressure is applied during use. It is therefore preferable to provide a visual indicator on the filter wrapping paper 3 to notify a user where to apply pressure to burst the blister 9 contained within. In order to ensure alignment of such a visual indicator with the optimal location for pressure to be applied to the blisters 9, it is necessary to control the orientation of the blisters 9 as they are fed into the filter tow material 2. Put another way, it is intended that each flat surface 17 of each blister 9 remains in planar alignment during unravelling of the blister chain 22. Therefore, the curved connecting portions 26 of the blister 9 chains 22 are provided with compensating geometry that allows the curved connecting portions 26 to be straightened without the manifestation of a rotational force on the blisters 9.

Figure 6:
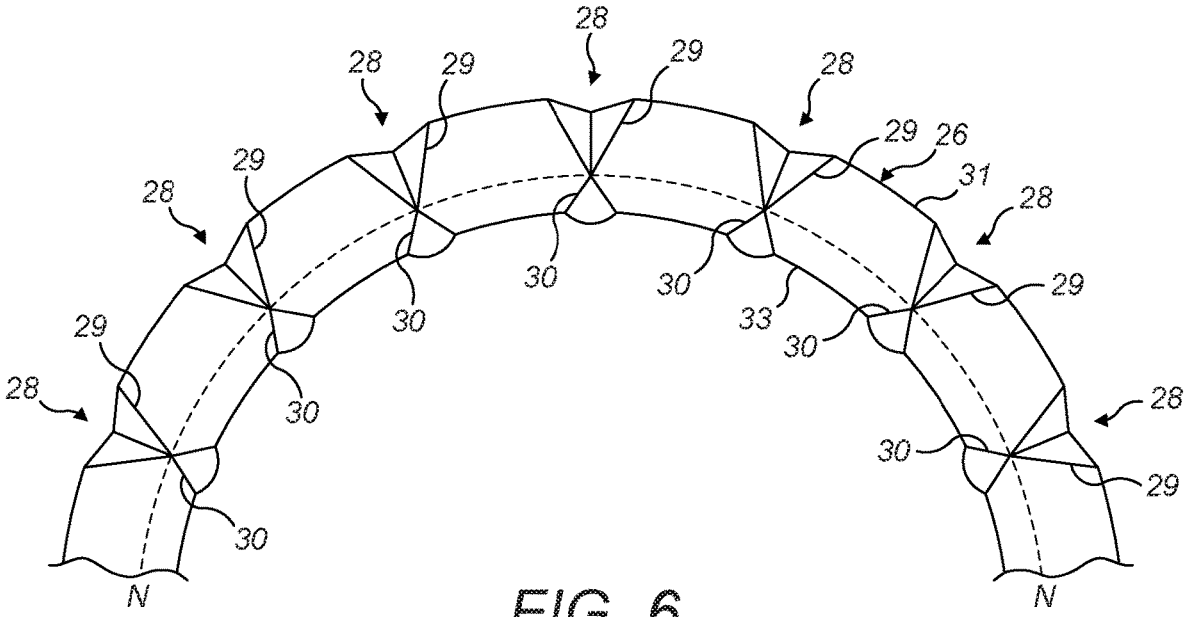
FIG. 6 shows a curved connecting portion comprising compensating geometry.

In one example, shown in FIG. 6, the compensating geometry comprises pleated sections 28 of the curved connecting portion 26. The pleated sections 28 may be embossed into the web 18 by the driving rollers 20 or by a separate pair of pleat embossing rollers (not shown). In either case the particular pattern of the pleated sections 28 is mapped across the face of one of the rollers as series of protrusions and across the other of the rollers as a series of corresponding impressions. As the web 18 passes between the rollers, the protrusions and impressions mate at the interface between the rollers, trapping the web 18 in between to plastically emboss the pleated sections 28. It is desirable that the embossing rollers comprise pockets in their surface to accommodate the blisters 9 as they pass in between the rollers.

Alternatively, the pleated sections 28 may be laser embossed into the web 18. This involves irradiating the area to be embossed with a laser (not shown). The irradiated area partially melts and stretches, which has much the same effect as had the area been embossed using embossing rollers as described above. The degree of stretching can be controlled by the power of the laser. The laser can also be used to partially ablate the surface of the web 18 to form a fold line or similar, so that a pattern of fold lines and embossed areas can be formed by a single laser installation. The laser may comprise a laser head (not shown) disposed immediately above or below the web 18 that maps out the embossing pattern by scanning back and forth across the surface of the web 18 as it passes. Laser embossing works particularly well where the first and second sheets 10, 17 of the web 18 are made from a polymer material.

It shall be appreciated that the process of embossing the pleated sections 28 into the web 18 must be in register with the process of cutting the blister chain 22 to ensure that the pleated sections 28 are formed about the curved connecting portions 26 as shown in FIG. 6.

Referring still to FIG. 6, the pleated sections 28 may comprise a first arrangement of fold lines 29 configured to ease compression in material radially outward of the neutral axis N-N of the curved connecting portion 26; and a second arrangement of fold lines 30 configured to ease tension in material radially inward of the neutral axis N-N.

The fold lines 29, 30 extend radially from points located on the curved connecting portion 26, preferably on the neutral axis N-N of the curved connecting portion, as shown.

Figure 7:
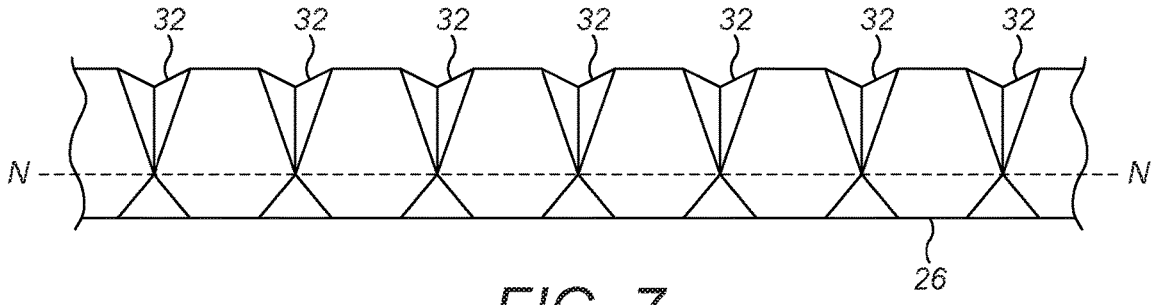
FIG. 7 shows the curved connecting portion of FIG. 7, straightened.

The first arrangements of fold lines 29 extend radially from a point toward the respective curved connecting portion's outer edge 31. Each of the first arrangement of fold lines comprises at least two fold lines, but preferably at least three fold lines. When the curved connecting portions 26 are straightened, the material delimited by the fold lines fold out of the plane of curvature of the associated curved connecting portion 26, forming small pyramidal ridges 32 which alleviate the compressive force in material outward of the neutral axis. This is shown most clearly in FIG. 7 which shows a straightened curved connecting portion 26.

The second arrangements of fold lines 30 extend radially from a point toward the respective curved connecting portion's inner edge 33. Regions of material delimited by the second arrangement of fold lines 30 are stretched by the embossing process to provide slack in the curved connecting portion 26 radially inward of the neutral axis N-N. When the curved connecting portions 26 are straightened the slack is taken up, reducing the amount of material that must be stretched and alleviating tension radially inward of the neutral axis N-N.

By alleviating tensile and compressive forces in the curved connecting portions 26 during straightening, the tendency for blisters 9 either side of any given curved connecting portion 26 to twist is reduced.

Figure 8:
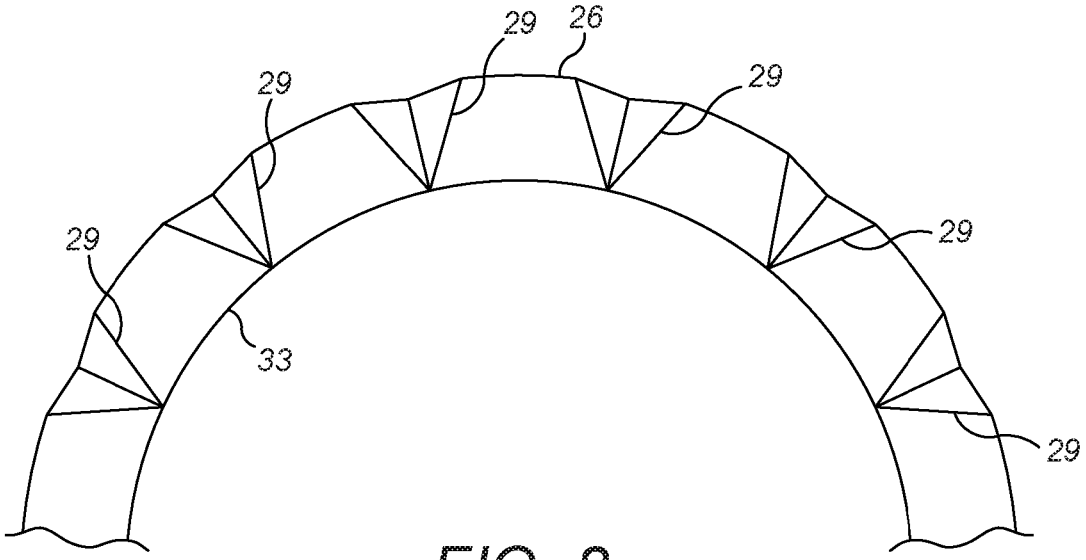
FIG. 8 shows a curved connecting portion comprising compensating geometry.

Although preferably each of the curved connecting portions 26 comprise both first and second arrangements of fold lines 29, 30 that extend over opposite sides of the neutral axis N-N; in another example, the curved connecting portions 26 comprise only one of the first or second arrangement of fold lines 29, 30. In such examples where only a first arrangement of fold lines 29 is provided, it is preferable that the points from which the fold lines 29 radiate are located on the neutral axis N-N. However, they may be located elsewhere, such as on the inner edges 33 of the curved connecting portions as shown in the example of FIG. 8.

Figure 9:
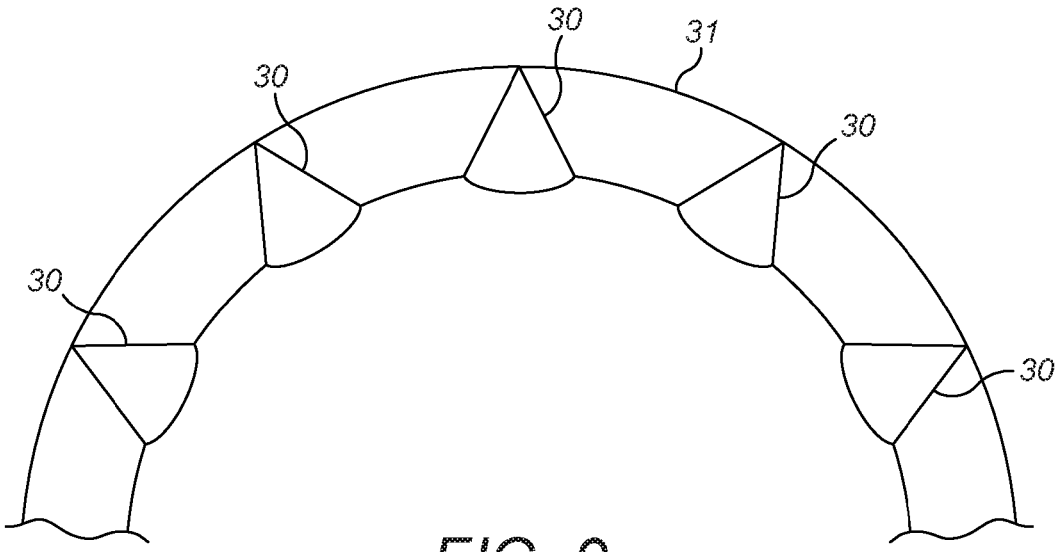
FIG. 9 shows a curved connecting portion comprising compensating geometry.

In such examples where only a second arrangement of fold lines 30 is provided, it is again preferable that the points from which the fold lines radiate are located on the neutral axis N-N. However, they may also be located outward of the neutral axis, such as on the outer edges 31 of the curved connecting portions 26 as shown in the illustrated example of FIG. 9.

It shall be appreciated that the neutral axes N-N of the curved connecting portions 26 will be located closer to the inner edges 33 than the outer edges 31. The exact location of the neutral axis is determined by curved beam bending theory and will be apparent to the skilled person.

Figure 11:
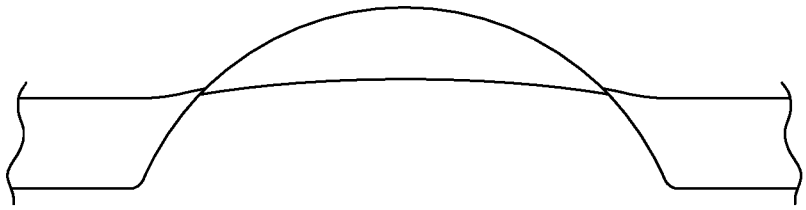
FIG. 11 shows the curved connecting portion of FIG. 10, straightened.
Figure 10:
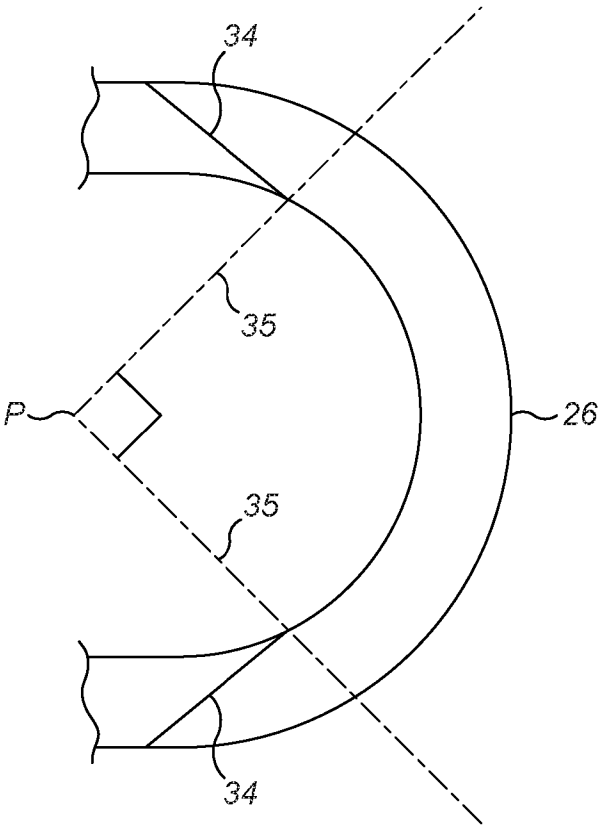
FIG. 10 shows a curved connecting portion comprising compensating geometry.

Another example of compensating geometry, shown in FIG. 10, comprises two fold lines 34, each located adjacent the ends of the curved connecting portions 26. The fold lines 34 are configured to allow the curved connecting portions 26 to twist relative to the blisters 9, while the blisters 9 remain rotationally aligned to each other, as shown in FIG. 11. Preferably, the fold lines 34 are arranged at about 90 degrees to a respective orthogonal line 35. Each orthogonal line extends from a centre point P of the curved connecting portion 26 and is perpendicular to the other, as illustrated.

Figure 12:
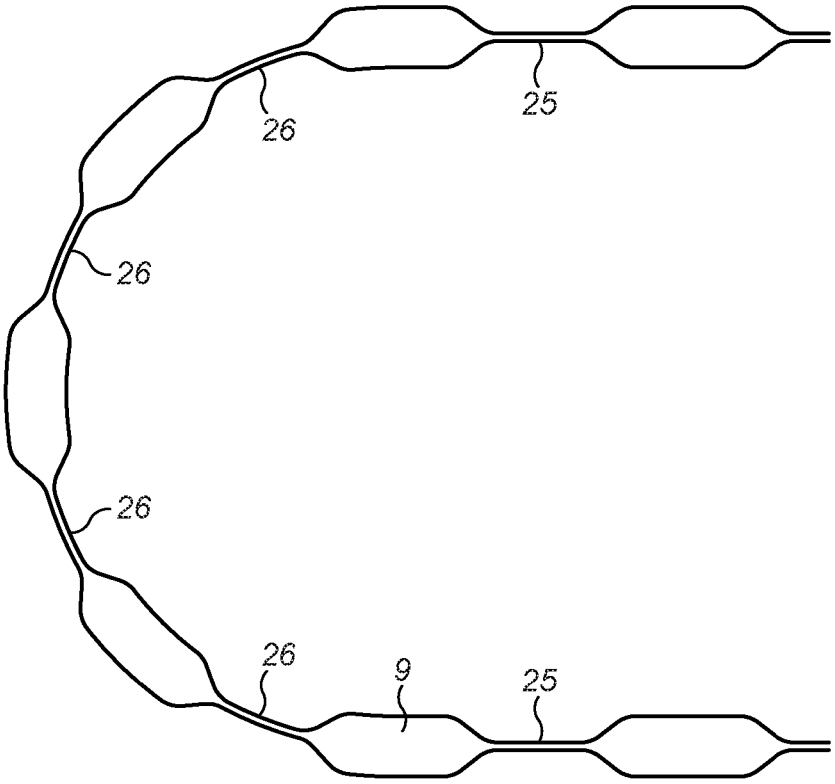
FIG. 12 shows an additive assembly.

Another example of compensating geometry is shown in FIG. 12. In this example, the curved connecting portions 26 do not form a semicircle, but a smaller segment so that each connecting portion 26 turns through a smaller arc. This results in less bending of the curved connecting portions 26 as they are straightened reducing the tendency for the blisters 9 either side of the curved connecting portions to twist. However, this example does result in more waste material.

It shall be appreciated that a further advantage of the additive assembly systems described above is that they maintain an even spacing of blisters 9 fed into the filter tow 2, the spacing between the blisters 9 being set by the length of the connecting portions 25, 26. This is important as the continuous filter rod 4 that is formed in the garniture 1 is later cut into individual filter rods during a cutting process, as mentioned above. The cutting process must be kept in register with blister 9 insertion to ensure that each individual filter rod contains a single blister 9 at a predetermined position along its length.

Figure 13:
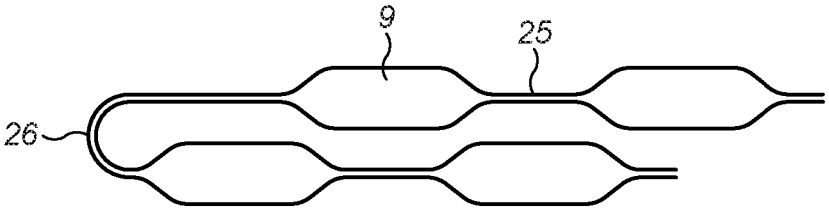
FIG. 13 shows an additive assembly.

The curved connecting portions 26 are preferably the same length, when straightened, as the straight connecting portions 25 to more easily determine the precise position of the blisters 9 for successful registration with the cutting process. However, it is possible to configure the cutting process to accommodate for differences in the length of the connecting portions 25, 26 if, for example, connecting portions 25, 26 of different lengths are required. Another example of an additive assembly is shown in FIG. 13. In this example the curved connecting portions 26 are longer than the straight connecting portions 25 to allow the blisters 9 to tessellate, as shown. This enables a greater number of blisters 9 to be formed in any given web 18 and reduces waste.

It shall be appreciated that the invention is not intended to be limited to the above described technique of forming blisters 9, in which pockets 13 are embossed into a first sheet 10, filled with additive and then enclosed by a second sheet 17. The important aspect of the invention is that an array of discrete portions of additive 9 are formed on a web 18 of material to increase the throughput of additive 9. This necessitates cutting a chain 22 of additive portions 9 from the web 18 having curved connecting portions 26 which are unravelled as the chain 22 is pulled into filter tow 2.

Figure 14:
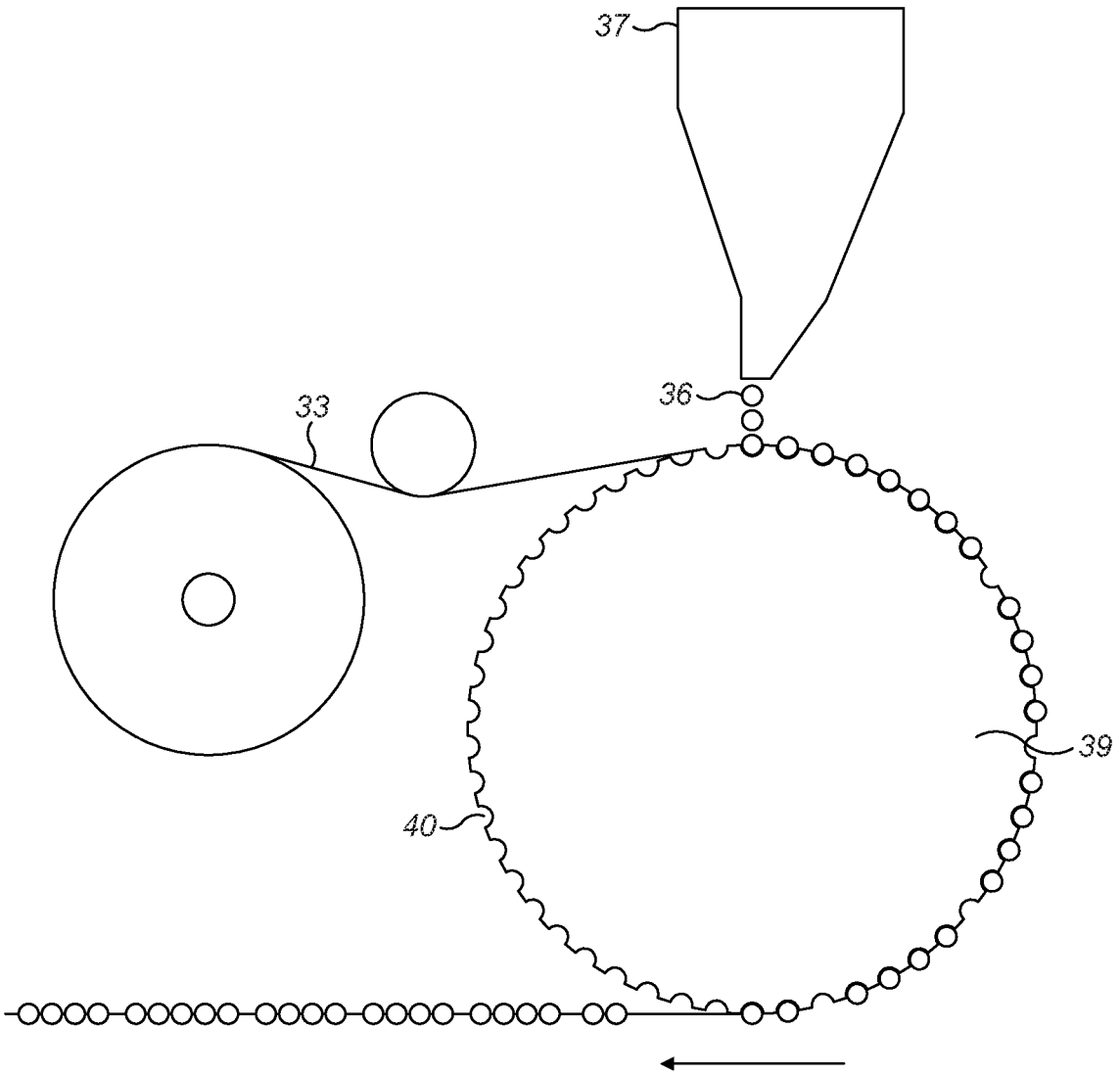
FIG. 14 shows a schematic of part of an additive assembly maker.

For example, in another embodiment shown in FIG. 14, spherical additive containing capsules 36 are provided in a hopper 37. The hopper 37 comprises multiple channels (not shown), each having a discrete opening arranged above a web of material 38. The openings are configured to feed the capsules 36 onto the web 38 in an array that is at least two capsules 36 wide across the width of the web 38. The web 38 is supported by an outer cylindrical surface of a carousel 39. The surface comprises an array of pockets 40 that corresponds to the array of capsules 36 as they are fed onto the web 38. The web 38 is drawn into the pockets 40 by vacuum and an adhesive is applied to the web 38. The capsules 36 are then fed into the web lined pockets 40 where they remain due to the adhesive, after the web 38 has departed the carousel 39.

The web 38 comprising the capsule 36 array may then be passed through the cutting rollers 27, as explained above, to provide a chain 22 of additive containing capsules 36 comprising curved connecting portions 26.

Figure 15:
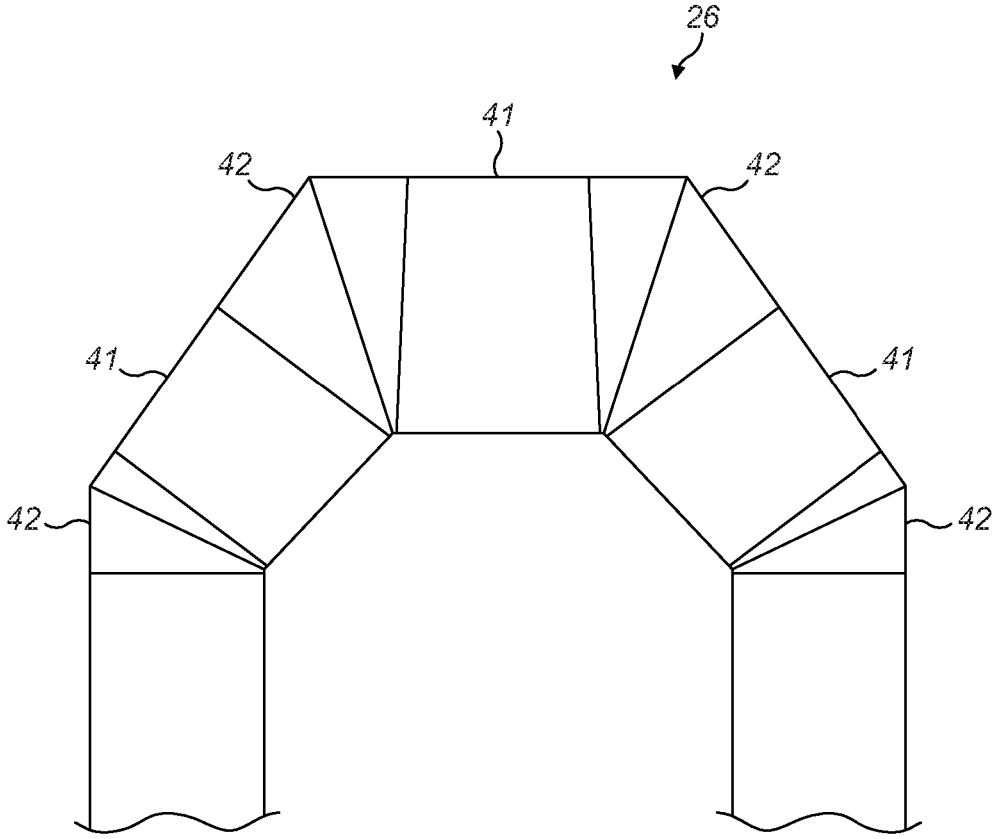
FIG. 15 shows a curved connecting portion formed of linear sections.

Although in the above described embodiments the curved connecting portions 26 describe generally smooth curves, the skilled person will appreciate that a smooth curve is not essential to the invention, rather that the primary consideration when constructing a curved connecting portion 26 is that it is nonlinear. For example, in the embodiment illustrated by FIG. 15 the curved connecting portions 26 comprise 5 linear sections 41 that describe a U shape. However, any number of linear sections 41 greater than 1 could be used. In this embodiment, the compensating geometry comprises pleated sections 42 provided between the linear sections 41 that are configured to fold in a concertina fashion when a straightening force is applied.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

Embodiments of the invention are described with reference to tobacco industry products, for example cigarettes. However, it will be appreciated that packages of the invention may alternatively be used for non-tobacco industry related products.

In order to address various issues and advance the art, the entirety of this disclosure shows by way of illustration various embodiments in which the claimed invention(s) may be practiced and provide a superior package for tobacco industry products. The advantages and features of the disclosure are of a representative sample of embodiments only, and are not exhaustive or exclusive. They are presented only to assist in understanding and teach the claimed features. It is to be understood that advantages, embodiments, examples, functions, features, structures, or other aspects of the disclosure are not to be considered limitations on the disclosure as defined by the claims or limitations on equivalents to the claims, and that other embodiments may be utilised and modifications may be made without departing from the scope or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of preparing an additive assembly for insertion into tobacco industry product filter tow, the method comprising:

providing a web comprising an array of discrete portions of additive disposed in or on the web, the array comprising columns of at least two discrete portions of additive across a width of the web;

forming a chain of discrete portions of additive in the web, the chain comprising:

connecting portions that connect adjacent discrete portions of additive in a column of the array; and connecting portions that are configured to be nonlinear to connect discrete portions of additive in respective adjacent columns of the array;

wherein the discrete portions of additive comprise additive filled blisters, and wherein the blisters comprise a flat surface, the flat surfaces of at least two adjacent blisters in the chain being in planar alignment, the at least two adjacent blisters being connected by at least one of the connecting portions that are configured to be nonlinear; and wherein the at least one connecting portion configured to be nonlinear comprises compensating geometry configured so that, following the application of a straightening force to the at least one connecting portion configured to be nonlinear, said flat surfaces remain in planar alignment.

2. A method according to claim 1, further comprising forming the array of discrete portions of additive in the web.

3. A method according to claim 2, wherein forming the array of discrete portions of additive in the web comprises:

providing a first sheet comprising an array of pockets; introducing an additive into the pockets; and introducing a second sheet overlying the first sheet to seal the pockets and form the web.

4. A method according to claim 3, wherein the method further comprises forming the array of pockets in the first sheet.

5. A method according to claim 4, wherein forming the array of pockets comprises passing the first sheet between a pair of embossing rollers to emboss the pockets into the first sheet.

6. A method according to claim 3, wherein the first and second sheets are passed in overlying relation between a pair of rollers, wherein at least one of the pair of rollers is heated to fuse the first and second sheets together.

7. A method according to claim 1, wherein forming the chain comprises passing the web of material between a pair of cutting rollers to cut the chain into the web of material.

8. A method according to claim 1, wherein forming the chain comprises using a laser to ablate the web around the discrete portions of additive.

9. A method according to claim 1, wherein the web of material comprises a polymer.

10. A method according to claim 1, wherein the connecting portions that are configured to be nonlinear are curved.

11. A chain for insertion into tobacco industry product filter tow, the chain comprising discrete portions of additive linked by connecting portions, wherein at least one of the connecting portions is configured to be nonlinear, wherein the discrete portions of additive comprise additive filled blisters, and wherein the blisters comprise a flat surface, the flat surfaces of at least two adjacent blisters in the chain being in planar alignment, the at least two adjacent blisters being connected by the at least one connecting portion configured to be nonlinear, and wherein the at least one connecting portion configured to be nonlinear comprises compensating geometry configured so that, following the application of a straightening force to the at least one connecting portion configured to be nonlinear, said flat surfaces remain in planar alignment.

12. A chain according to claim 11, wherein the compensating geometry comprises a pleated section in the connecting portion configured to be nonlinear.

13. A chain according to claim 12, wherein the pleated section is embossed or scored into the connecting portion configured to be nonlinear.

14. A chain according to claim 13, wherein the pleated section comprises first fold lines configured to ease compression radially outward of a neutral axis of the connecting portion configured to be nonlinear; and second fold lines configured to ease tension radially inward of the neutral axis.

15. A chain according to claim 14, wherein the first fold lines extend radially from a point located on the neutral axis to an outer edge of the connecting portion configured to be nonlinear and the second fold lines extend radially from said point on the neutral axis to an inner edge of the connecting portion configured to be nonlinear.

16. A chain according to claim 15, wherein material delimited by the second fold lines is pre-stretched to provide slack in the connecting portion configured to be nonlinear between the neutral axis and the inner edge.

17. A method of preparation of a tobacco industry product using the additive chain of claim 11, comprising:

drawing the chain of discrete portions of additive into tobacco industry material;

forming the tobacco industry material into a continuous rod; and wrapping the tobacco industry material with a wrapping material.

18. A tobacco industry product comprising a filter having a discrete portion of additive, wherein the discrete portion of additive is attached to a connecting portion configured to be nonlinear; wherein the discrete portion of additive comprises an additive filled blister, and wherein the blister comprises a flat surface in a planar arrangement; and wherein the connecting portion configured to be nonlinear comprises compensating geometry configured so that, following the application of a straightening force to the connecting portion configured to be nonlinear, the flat surface remains in planar alignment.

19. A tobacco industry product comprising a filter having two discrete portions of additive embedded therein, wherein the discrete portions of additive are attached to each other by a connecting portion configured to be nonlinear; wherein the discrete portions of additive comprise additive filled blisters, and wherein the blisters comprise a flat surface, the flat surfaces of the two blisters being in planar alignment, the two blisters being connected by the connecting portion configured to be nonlinear; and wherein the at least one connecting portion configured to be nonlinear comprises compensating geometry configured so that, following the application of a straightening force to the connecting portion configured to be nonlinear, said flat surfaces remain in planar alignment.

* * * * *